US012637828B2

(12) United States Patent
Gentle et al.

(10) Patent No.: US 12,637,828 B2
(45) Date of Patent: May 26, 2026

(54) CONTROL OF A MACHINE TO END A WINDROW

(71) Applicant: Caterpillar Inc., Peoria, IL (US)

(72) Inventors: Michael Charles Gentle, Maroa, IL (US); Ethan Michael Tevis, Bloomington, IL (US); Joshua T. Hayes, Table Grove, IL (US)

(73) Assignee: Caterpillar Inc., Peoria, IL (US)

( * ) Notice: Subject to any disclaimer, the term of this patent is extended or adjusted under 35 U.S.C. 154(b) by 360 days.

(21) Appl. No.: 18/334,855

(22) Filed: Jun. 14, 2023

(65) Prior Publication Data

US 2024/0417950 A1 Dec. 19, 2024

(51) Int. Cl.

| | |
|---|---|
| ***E02F 3/84*** | (2006.01) |
| ***E02F 3/76*** | (2006.01) |
| ***E02F 9/26*** | (2006.01) |

(52) U.S. Cl.

CPC ..... *E02F 3/841* (2013.01); *E02F 3/764* (2013.01); *E02F 3/7645* (2013.01); *E02F 3/844* (2013.01); *E02F 9/265* (2013.01)

(58) Field of Classification Search

CPC . E02F 3/841; E02F 3/844; E02F 3/845; E02F 3/847; E02F 3/84; E02F 3/80; E02F 3/76; E02F 3/764; E02F 3/7645; E02F 3/765; E02F 3/7654; E02F 3/7636; E02F 9/265; E02F 9/264; E02F 9/262; B60L 2250/10; B60W 2050/143; B60W 2050/146; B60W 50/16; B60W 50/14

USPC ..... 701/50

See application file for complete search history.

(56) References Cited

U.S. PATENT DOCUMENTS

| | | | | |
|---|---|---|---|---|
| 3,999,615 | A | 12/1976 | Hart et al. | |
| 6,064,933 | A * | 5/2000 | Rocke | E02F 3/434 172/12 |
| 8,060,299 | B2 | 11/2011 | Gharsalli et al. | |
| 8,807,261 | B2 | 8/2014 | Subrt et al. | |
| 9,637,889 | B2 | 5/2017 | Elkins | |
| 9,809,956 | B1 | 11/2017 | Sherlock | |
| 10,550,543 | B1 | 2/2020 | Ennis et al. | |

(Continued)

FOREIGN PATENT DOCUMENTS

| | | | |
|---|---|---|---|
| BR | 202018002633 U2 * | 8/2019 | A01B 13/02 |
| CN | 115003884 A | 9/2022 | |

OTHER PUBLICATIONS

"Cat Motor Grader Application Training: Finishing a Pass", Aug. 14, 2020, Cat Products, Youtube.com, https://www.youtube.com/watch?v=Mx2b6dUnHb0 (Year: 2020).*

(Continued)

*Primary Examiner* — Erin M Piateski
*Assistant Examiner* — Ashley Tiffany Schoech

(57) ABSTRACT

A controller for a work machine may cause increasing of an angle of a ground-engaging implement of the work machine while maintaining a distance between a trailing edge of the ground-engaging implement and a center line of the work machine. The controller may detect that the work machine has traveled a particular distance from a location of the work machine at a time of increasing of the angle of the ground-engaging implement. The controller for the work machine may cause the work machine to steer away from a windrow based on detecting that the work machine has traveled the particular distance.

20 Claims, 5 Drawing Sheets

(56) References Cited

U.S. PATENT DOCUMENTS

| | | | | |
|---|---|---|---|---|
| 10,753,065 | B2 | 8/2020 | Ono | |
| 2015/0259882 | A1* | 9/2015 | Sharma | E02F 9/225 701/41 |
| 2017/0009426 | A1* | 1/2017 | Wei | E02F 9/2041 |
| 2018/0038066 | A1 | 2/2018 | Gentle et al. | |
| 2020/0055544 | A1 | 2/2020 | Veasy et al. | |
| 2020/0094853 | A1* | 3/2020 | Tate | B60W 50/16 |
| 2020/0115884 | A1* | 4/2020 | Christofferson | E02F 3/841 |
| 2020/0173139 | A1* | 6/2020 | Gentle | E02F 3/765 |
| 2020/0205345 | A1* | 7/2020 | Bollinger | A01D 57/26 |
| 2022/0126827 | A1 | 4/2022 | Sahoo et al. | |
| 2023/0417012 | A1* | 12/2023 | Elkins | E02F 3/7645 |

OTHER PUBLICATIONS

Peng Qi et al., "3D Guidance Navigation and Human-Robot Shared Control for Motor Graders in Field Operation", 2022, ICMRE, 8th ICMRE, pp. 79-83 (Year: 2022).*

* cited by examiner

CONTROL OF A MACHINE TO END A WINDROW

TECHNICAL FIELD

The present disclosure relates generally to earth-moving machines and, for example, to control of a machine to end a windrow.

BACKGROUND

Earthmoving machines, such as motor graders, are used to perform displacement, distribution, and leveling of material, such as soil. For example, a motor grader shapes or levels a ground surface by forcing an implement, such as a blade, to bear against the ground surface over which the motor grader is driven. A windrow is a ridge or a long, narrow pile of material formed by the motor grader while performing road construction or maintenance operations. During a grading operation, the motor grader may move windrows over multiple passes, thereby blending and mixing ground material until the material is spread evenly.

The motor grader typically includes a linkage assembly for the implement that can control an angle of the implement, raising and lowering of the implement, lateral shifts of the implement, and a pitch of the implement. Due to the many degrees of freedom of the implement, an operator of the motor grader may have difficulty controlling the position of the implement. Accordingly, a windrow formed by the motor grader may be ended (e.g., at an end of a pass) with a lack of precision, where an end of the windrow is characterized by material spread out over a large area rather than a tight taper. As a result, the windrow may not be fully cleared on a return pass, thereby leaving excess material behind. The excess material may result in an uneven surface, may prevent adequate mixing of material, and/or may eventually lead to more frequent road maintenance. Moreover, the excess material may wear or damage the tires of the motor grader or of other machines traversing the area. Furthermore, the excess material can become compacted, making removal and repair of the excess material time consuming.

The control system of the present disclosure solves one or more of the problems set forth above and/or other problems in the art.

SUMMARY

A motor grader may include a front portion, a rear portion, an articulated joint between the front portion and the rear portion, a linkage assembly of the front portion including a drawbar, a circle connected to the drawbar, and a ground-engaging implement, connected to the circle, positionable at an angle that defines a leading edge and a trailing edge of the ground-engaging implement, and a controller. The controller may be configured to receive an input indicating that a windrow, being formed by the motor grader in connection with a grading operation, is to be ended. The controller may be configured to cause, based on the input, increasing of the angle of the ground-engaging implement by articulation of the front portion relative to the rear portion and rotation of the circle. The controller may be configured to detect that the motor grader has traveled a particular distance from a location of the motor grader at a time of increasing of the angle of the ground-engaging implement. The controller may be configured to perform a windrow-ending action based on detecting that the motor grader has traveled the particular distance.

A control system for a work machine having a linkage assembly including a drawbar, a circle connected to the drawbar, and a ground-engaging implement, connected to the circle, positionable at an angle that defines a leading edge and a trailing edge of the ground-engaging implement. The control system may include one or more sensors configured to detect a position of the ground-engaging implement, a circle rotation actuator configured to rotate the circle, an articulation actuator configured to articulate a front portion of the work machine relative to a rear portion of the work machine, and a controller. The controller may be configured to identify that the work machine is to perform an operation to end a windrow being formed by the work machine in connection with a grading operation. The controller may be configured to cause, based on identifying that the work machine is to perform the operation, increasing of the angle of the ground-engaging implement by articulation of the front portion relative to the rear portion and rotation of the circle. The controller may be configured to detect that the work machine has traveled a particular distance from a location of the work machine at a time of increasing of the angle of the ground-engaging implement. The controller may be configured to perform a windrow-ending action based on detecting that the work machine has traveled the particular distance.

A method to end a windrow being formed by a work machine may include causing, by a controller for the work machine, increasing of an angle of a ground-engaging implement of the work machine while maintaining a distance between a trailing edge of the ground-engaging implement and a center line of the work machine. The method may include detecting that the work machine has traveled a particular distance from a location of the work machine at a time of increasing of the angle of the ground-engaging implement. The method may include causing the work machine to steer away from the windrow based on detecting that the work machine has traveled the particular distance.

DETAILED DESCRIPTION

This disclosure relates to a control system, which is applicable to any machine that includes a ground-engaging implement. For example, the machine may be a motor grader, a dozer, a loader, a plow, a harvesting machine, or the like.

Figure 1:
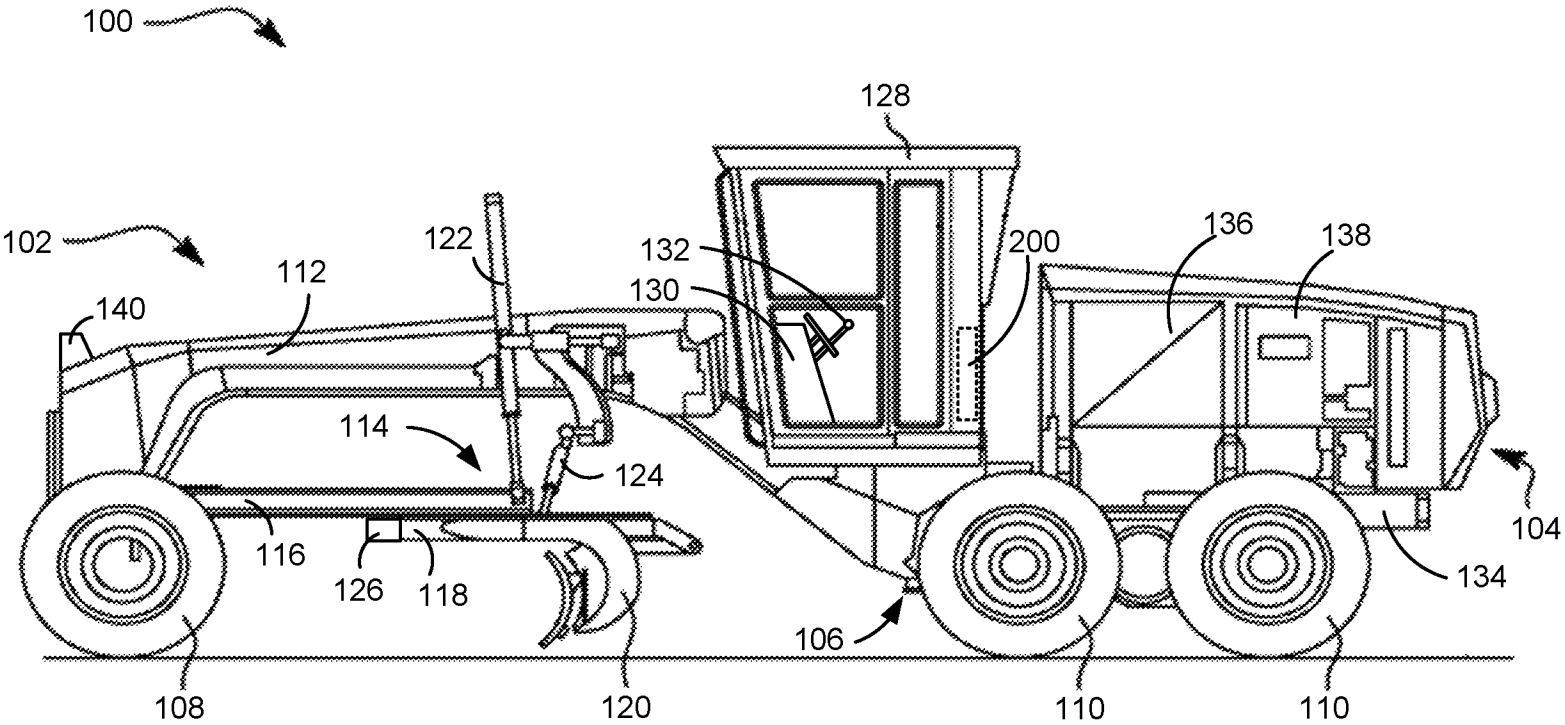
FIG. 1 is a side elevational view of an example machine.

FIG. 1 is a side elevational view of an example machine 100. The machine 100 is a work machine. FIG. 1 shows an example where the machine 100 is a motor grader. However, as described above, the machine 100 may be any machine that includes a ground-engaging implement.

The machine 100 includes a steerable front portion 102 and a driven rear portion 104. An articulated joint 106 (e.g., which includes a hinge) may be between the front portion 102 and the rear portion 104 to permit the front portion 102 and the rear portion 104 to articulate relative to each other. The front portion 102 and the rear portion 104 are supported on front ground engaging members and rear ground engaging members, respectively, which are shown as a pair of front wheels 108 (only a left-side wheel 108 is visible in FIG. 1), supporting the front portion 102, and one or more pairs of rear wheels 110 (only left-side wheels 110 are visible in FIG. 1) supporting the rear portion 104. Alternatively, the ground engaging members may include one or more track assemblies, or the like.

The front portion 102 includes a front frame section 112. A linkage assembly 114 is mounted to the front frame section 112 and may be utilized for grading. The linkage assembly 114 includes a drawbar 116 pivotably mounted to the front frame section 112 (e.g., via a ball joint (not shown)), a circle 118 connected to the drawbar 116, and a ground-engaging implement 120, such as a blade or a moldboard, connected to the circle 118 (e.g., the linkage assembly 114 may include a drawbar-circle-moldboard assembly). A position of the drawbar 116 may be controlled by lift cylinders 122 (only one of which is visible in FIG. 1) and a drawbar centershift cylinder 124. The lift cylinders 122 may control raising and lowering of the implement 120 relative to a ground surface, and/or tilting of the implement 120 relative to the ground surface (e.g., when lift cylinders 122 are operated independently of each other). The drawbar centershift cylinder 124 may control lateral shifting of the implement 120 relative to the front frame section 112. An angular position of the circle 118 may be controlled by a circle drive motor 126 (e.g., a hydraulic motor). For example, the circle 118 may include a plurality of gear teeth engaged with a gear coupled to the circle drive motor 126. The circle drive motor 126 may control an angle of the implement 120 relative to the front frame section 112 by rotation of the circle 118.

A position of the implement 120 may be controlled by a blade pitch cylinder (not shown) and/or a blade sideshift cylinder (not shown). The blade pitch cylinder may control a forward or a rearward rotation of a top edge of the implement 120. The blade sideshift cylinder may control lateral shifting of the implement 120 relative to the front frame section 112. Accordingly, the linkage assembly 114 enables the implement 120 to be moved to a variety of different positions. For example, the implement 120 may be positionable at an angle, relative to the front frame section 112, that defines a leading edge (also referred to as a "toe") and a trailing edge (e.g., also referred to as a "heel") of the implement 120. The leading edge of the implement 120 is a forward edge of the implement 120 relative to a travel direction of the machine 100, and the trailing edge is a rearward edge of the implement 120 relative to a travel direction of the machine 100.

The machine 100 may include an operator cab 128. The operator cab 128 may include a console 130 and one or more operator controls 132. The console 130 may include a display, a touchscreen display, and/or one or more operating mode selectors (e.g., buttons, switches, or the like). The operator controls 132 may include a steering mechanism, a speed-throttle, a control lever, a joystick, a touchscreen control, or the like. An operator occupying the operator cab 128 can control various functions of the machine 100 using the console 130 and/or the operator controls 132.

The rear portion 104 includes a rear frame section 134. A prime mover 136 is supported on the rear frame section 134. The prime mover 136 may include an engine (e.g., an internal combustion engine), such as a diesel engine, a gasoline engine, or a gaseous fuel engine, among other examples. Additionally, or alternatively, the prime mover 136 may include an electric motor (e.g., for electric powering of machine 100 or hybrid powering of machine 100 with the engine). The prime mover 136 is configured to propel the machine 100 via the rear wheels 110. The prime mover 136 may be coupled to a hydraulic system 138. The hydraulic system 138 may include one or more pumps (not visible) to drive or power operations of the machine 100, such as steering of the wheels 108 or the wheels 110, or movement of the linkage assembly 114 to control a position of the implement 120.

The machine 100 includes one or more sensors 140 mounted on the front frame section. The sensor(s) 140 may be directed at an area forward of the machine 100 and configured to collect data relating to an arrangement (e.g., a size, a shape, and/or a location) of one or more windrows on a ground surface being worked by the machine 100. A sensor 140 may include an optical sensor, such as a camera (e.g., a two-dimensional camera, a three-dimensional camera, or a stereo camera) or a lidar sensor, a sonic sensor (e.g., an ultrasonic sensor), and/or a radio sensor (e.g., a radar sensor), among other examples.

Figure 2:
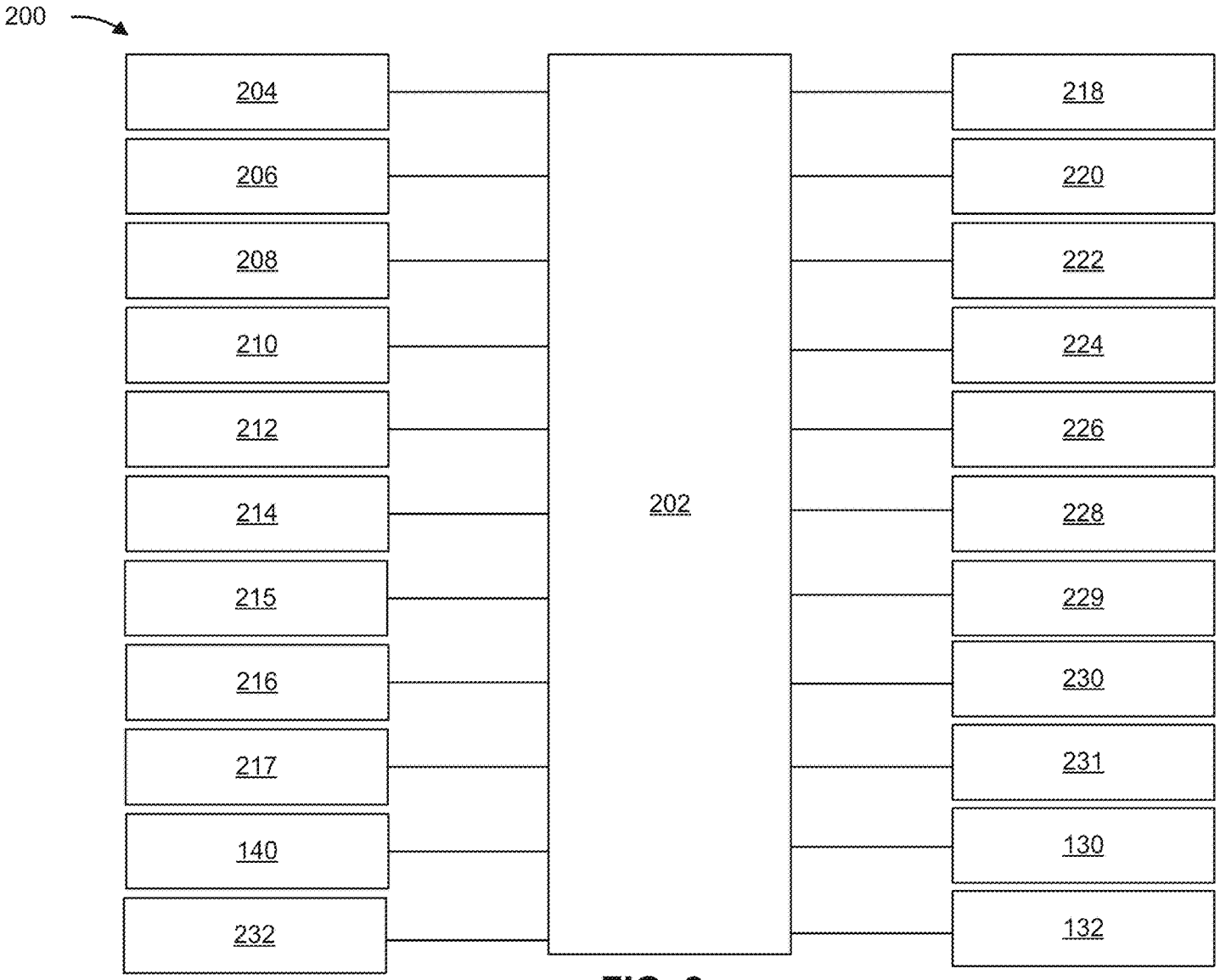
FIG. 2 is a diagram of an example control system.

The machine 100 includes a control system 200, described further in connection with FIG. 2. The control system 200 may enable autonomous grading control for the machine 100. Operations for the autonomous grading control may be performed in connection with an autonomous mode or a semi-autonomous mode of the machine 100. Alternatively, operations for the autonomous grading control may be performed in connection with an operator assistance mode of the machine 100 that provides autonomous or semi-autonomous operation of particular functions of the machine 100 while the machine 100 is otherwise being operated manually.

As indicated above, FIG. 1 is provided as an example. Other examples may differ from what is described with regard to FIG. 1.

FIG. 2 is a diagram of an example control system 200. The control system 200 includes a controller 202 (e.g., an electronic control module (ECM)). The controller 202 includes one or more memories and one or more processors communicatively coupled to the one or more memories. A processor may include a central processing unit, a graphics processing unit, a microprocessor, a controller, a microcontroller, a digital signal processor, a field-programmable gate array, an application-specific integrated circuit, and/or another type of processing component. The processor may be implemented in hardware, firmware, or a combination of hardware and software. The processor may be capable of being programmed to perform one or more operations or processes described elsewhere herein. A memory may include volatile and/or nonvolatile memory. For example, the memory may include random access memory (RAM), read only memory (ROM), a hard disk drive, and/or another type of memory (e.g., a flash memory, a magnetic memory, and/or an optical memory). The memory may be a non-transitory computer-readable medium. The memory may store information, one or more instructions, and/or software (e.g., one or more software applications) related to the operation of the controller 202.

The control system 200 may include one or more implement position sensors communicatively coupled to the controller 202 and configured to detect a position of the implement 120. For example, the implement position sensors may include a blade sideshift sensor 204 to measure an amount of sideshift of the implement 120, a blade pitch sensor 206 to measure an amount of pitch of the implement 120, a left blade lift sensor 208 to measure an amount of lift at a left side of the implement 120, a right blade lift sensor 210 to measure an amount of lift at a right side of the implement 120, a circle rotation sensor 212 to measure an amount of rotation of the circle 118 (e.g., an angle of the implement 120), and/or drawbar centershift sensor 214 to measure an amount of centershift of the drawbar 116 (e.g., an amount of sideshift of the implement 120), among other examples. As an example, the blade sideshift sensor 204 may be coupled to the blade sideshift cylinder (not shown), the blade pitch sensor 206 may be coupled to the blade pitch cylinder (not shown), the left blade lift sensor 208 may be coupled to a left drawbar lift cylinder 122, the right blade lift sensor 210 may be coupled to a right drawbar lift cylinder 122, the circle rotation sensor 212 may be coupled to the circle 118, and the drawbar centershift sensor 214 may be coupled to drawbar centershift cylinder 124.

The control system 200 may also include a linkbar pin sensor 215 communicatively coupled to the controller 202 and configured to detect a position of a linkbar pin (not shown) of a linkbar (not shown) of the linkage assembly 114. In addition, the control system 200 may include a steering angle sensor 216 communicatively coupled to the controller 202 and configured to measure a steering angle or direction of the machine 100. Moreover, the control system 200 may include an articulation sensor 217 communicatively coupled to the controller 202 and configured to detect an articulation angle of the front portion 102 relative to the rear portion 104. An implement position sensor, the linkbar pin sensor 215, the steering angle sensor 216, and/or the articulation sensor 217 may include an inertial measurement unit (IMU), an angular position or rotary sensor, a linear displacement sensor, or another type of sensor. Additionally, the control system 200 may include the sensor(s) 140, which may be communicatively coupled to the controller 202. In some implementations, multiple sensors may be integrated into a single sensor, or a single sensor may perform the functions described above of multiple sensors.

Based on data from the aforementioned sensors, the controller 202 may generate and provide control signals to one or more actuators communicatively coupled to the controller 202. The actuators may include one or more implement position actuators. For example, the implement position actuators may include one or more blade sideshift actuators 218 to cause sideshifting of the implement 120, one or more blade pitch actuators 220 to cause pitch rotation of the implement 120, one or more left blade lift actuators 222 to cause raising or lowering of a left side of the implement 120, one or more right blade lift actuators 224 to cause raising or lowering of a right side of the implement 120, one or more circle rotation actuators 226 to cause rotation of the circle 118, and/or one or more drawbar centershift actuators 228 to cause centershifting of the drawbar 116, among other examples. As an example, the blade sideshift actuator 218 may control the blade sideshift cylinder (not shown), the blade pitch actuator 220 may control the blade pitch cylinder (not shown), the left blade lift actuator 222 may control a left drawbar lift cylinder 122, the right blade lift actuator 224 may control a right drawbar lift cylinder 122, the circle rotation actuator 226 may control the circle drive motor 126, and the drawbar centershift actuator 228 may control the drawbar centershift cylinder 124.

In addition, the actuators may include one or more linkbar pin actuators 229 to shift a position of the linkbar pin in the linkbar (e.g., the linkbar pin position in the linkbar may control a lateral position of the drawbar 116). Furthermore, the actuators may include one or more steering actuators 230 to control a steering angle of the machine 100 and/or a wheel lean of the machine 100. Moreover, the actuators may include one or more articulation actuators 231 to control an articulation angle of the front portion 102 relative to the rear portion 104 of the machine 100. An actuator may include a control valve or solenoid for a hydraulic cylinder, an electric actuator, or another type of actuator. In some implementations, multiple actuators may be integrated into a single actuator, or a single actuator may perform the functions described above of multiple actuators.

The control system 200 may include the console 130 and/or the operator controls 132, which may be communicatively coupled to the controller 202. For example, the controller 202 may receive an input, provided via the console 130 and/or the operator controls 132, indicating an operational mode for the machine 100. For example, the operational mode may include activation or deactivation of autonomous control of grading operations of the machine 100. Additionally, the controller 202 may output information for presentation on one or more displays of the console 130. For example, the information may indicate whether autonomous control of grading operations is activated or deactivated, a status of autonomous control of grading operations, or the like. In some implementations, a memory of the controller 202 may store information relating to the machine 100 (e.g., machine configuration parameters), such as dimensions of the machine 100, attachments on the machine 100, or the like. In some implementations, the control system 200 may include a joystick position motor 232 configured to provide force feedback for a joystick of the operator controls 132.

As indicated above, FIG. 2 is provided as an example. Other examples may differ from what is described with regard to FIG. 2.

Figure 3:
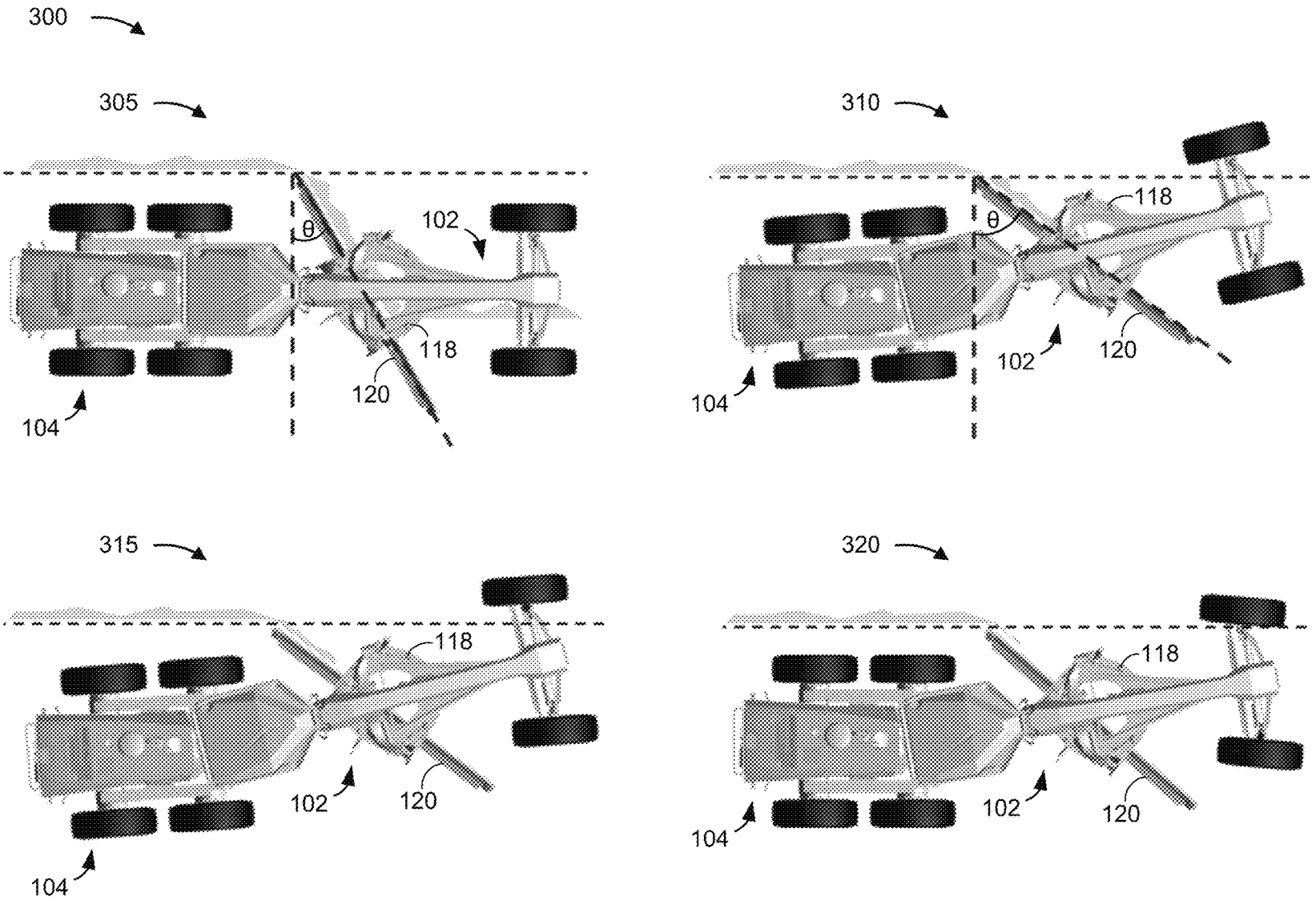
FIG. 3 is a diagram of an example associated with control of a machine to end a windrow.

FIG. 3 is a diagram of an example 300 associated with control of a machine to end a windrow.

The controller 202 may be configured to perform operations associated with autonomous control of grading operations of the machine 100, as described herein. During a grading operation (e.g., in which the machine 100 is traveling along a ground surface to perform one or more grading passes of the ground surface), the implement 120 may be positioned at an angle θ (e.g., relative to a transverse line to the rear portion 104) that defines a leading edge and a trailing edge of the implement 120, as described herein. For example, the implement 120 may be commanded to the angle by an operator of the machine 100. The controller 202 may monitor a position of the implement 120 during the grading operation to identify the leading edge and the trailing edge of the implement 120. For example, the controller 202 may (e.g., at regular or irregular intervals) detect a position of the implement 120 based on signals output by one or more of the implement position sensors, such as the circle rotation sensor 212. Continuing with the example, the controller 202 may determine, based on the position of the implement 120, whether the leading edge of the implement 120 is toward a first side (e.g., a left side) of the machine 100 or toward a second side (e.g., a right side) of the machine 100.

As shown by reference number 305, the controller 202 may identify that the machine 100 is to perform an operation to end a windrow being formed by the machine 100 in connection with the grading operation. The controller 202 may enter an autonomous windrow-ending mode based on identifying that the machine 100 is to perform the operation to end the windrow.

For example, to identify that the machine 100 is to perform the operation to end the windrow, the controller 202 may receive an input indicating that a windrow, being formed by the machine 100, in connection with the grading operation, is to be ended. As an example, the controller 202 may receive an input indicating that the machine 100 is to perform the operation to end the windrow. The controller 202 may receive the input via the console 130, via the one or more operator controls 132, via another input device of the operator cab 128, and/or via a remote control device for the machine 100. For example, an operator of the machine 100 may press a button to initiate an end-of-windrow sequence for the machine 100. The controller 202 may receive the input (e.g., the operator may press the button) when the machine 100 is approaching an end of a grading pass. In one example, the end of the grading pass may correspond to a time when a front end of the machine 100 has reached an end of a windrow formed during a previous grading pass. Additionally, or alternatively, the end of the grading pass may be in accordance with a site plan or an operating plan for the grading operation.

As another example, to identify that the machine 100 is to perform the operation to end the windrow, the controller 202 may obtain data collected by one or more sensors 140. For example, the data may be collected by one or more optical sensors and/or one or more sonic sensors of the machine 100. The data may indicate an arrangement of one or more windrows formed during the grading operation. For example, the data may include one or more images, a point cloud, and/or a three-dimensional model, among other examples, associated with the material (e.g., a ground surface) being worked by the machine 100 using the implement 120. The controller 202 may determine, based on the data, that the machine 100 is to perform the operation to end the windrow. For example, the controller 202 may determine, based on the data, the arrangement of the one or more windrows, and the controller 202 may determine that the machine 100 is to perform the operation to end the windrow based on the arrangement of the one or more windrows indicating that the machine 100 is approaching an end of a grading pass, in a similar manner as described above. As an example, the controller 202 may use a machine learning model (e.g., trained using a large number of images, point clouds, three-dimensional models, or the like) to identify that the machine 100 is approaching an end of a grading pass based on the arrangement of the one or more windrows indicated by the data.

As shown by reference number 310, the controller 202 may cause, based on identifying that the machine 100 is to perform the operation to end the windrow (e.g., based on the input), increasing of the angle θ of the implement 120 while maintaining a distance (e.g., an approximately fixed or constant distance) between a trailing edge of the implement 120 and a center line of the machine 100 (e.g., a center line of the rear portion 104 of the machine 100). For example, as the machine 100 is traveling along the ground surface to form the windrow, the trailing edge of the implement 120 may be translated along a straight line relative to the windrow being formed. The controller 202 may cause increasing of the angle of the implement 120 by articulation of the front portion 102 relative to the rear portion 104 and rotation of the circle 118. The articulation of the front portion 102 relative to the rear portion 104 may be concurrent (e.g., at least partially overlapping in time or simultaneous) with the rotation of the circle 118. To cause the articulation of the front portion 102 relative to the rear portion 104, the controller 202 may generate a control signal to cause actuation of the articulation actuator 231. To cause the rotation of the circle 118, the controller 202 may generate a control signal to cause actuation of the circle rotation actuator 226.

The articulation of the front portion 102 relative to the rear portion 104 may bring the front portion 102 nearer to the windrow being formed. For example, the articulation of the front portion 102 relative to the rear portion 104 may be an articulation in a direction of the trailing edge of the implement 120. The articulation of the front portion 102 relative to the rear portion 104 may be an articulation of X degrees (e.g., approximately 10 degrees or 15 degrees), as described further in connection with FIG. 4. The articulation of the front portion 102 relative to the rear portion 104 may be at a predetermined rate. The rotation of the circle 118 may bring the leading edge of the implement 120 nearer to the windrow being formed. The rotation of the circle 118 may be a rotation of Y degrees, as described further in connection with FIG. 4. The rotation of the circle 118 may be at a predetermined rate. The combination of the articulation of the front portion 102 relative to the rear portion 104 and the rotation of the circle 118 quickly increases the angle of the implement 120 to facilitate faster discharging of material away from the implement 120 to maintain a straight windrow.

In some implementations, the controller 202 may determine whether the articulation of the front portion 102 relative to the rear portion 104 and/or the rotation of the circle 118 is to result in a collision of the implement 120 with the machine 100 (e.g., that may damage ground engaging members of the machine 100, a ladder of the machine 100, or the like). Based on a determination that the articulation of the front portion 102 relative to the rear portion 104 and the rotation of the circle 118 are not to result in the collision of the implement 120 with the machine 100, the controller 202 may cause the increasing of the angle of the implement 120 (e.g., by articulation of the front portion 102 relative to the rear portion 104 and rotation of the circle 118).

The controller 202 may detect that the machine 100 has traveled a particular distance from a location of the machine 100 at a time of increasing of the angle of the implement 120 (e.g., from a start of increasing the angle of the implement 120). The particular distance may be at least half a length of the machine 100 (e.g., where the length is indicated by the information relating to the machine 100 stored in the memory of the controller 202). The controller 202 may perform a windrow-ending action based on detecting that the machine 100 has traveled the particular distance. For example, after the machine 100 has traveled the particular distance from the location of the machine 100 at the time of increasing of the angle of the implement 120, the controller 202 may perform the windrow-ending action.

As shown by reference number 315, to perform the windrow-ending action, the controller 202 may cause the machine 100 to steer away from the windrow. For example, the controller 202 may cause the machine 100 to steer in a direction of the leading edge of the implement 120. To cause the machine 100 to steer away from the windrow, the controller 202 may generate a control signal to cause actuation of the steering actuator(s) 230. The machine 100 steering away from the windrow, after the machine 100 has traveled the particular distance, maintains a straight windrow and causes material to quickly taper off the implement 120. Alternatively, to perform the windrow-ending action, the controller 202 may cause an alert to be provided indicating that the machine 100 is to be steered away from the windrow. The alert may include activation of an indicator light of the console 130, activation of haptic feedback for an operator control 132, presentation of a message on a display of the console 130, or the like. After performing the windrow-ending action, the windrow may be ended, as shown by reference number 320.

In some implementations, the controller 202 may cause, based on performing the windrow-ending action, an adjustment to a pitch of the implement 120 to raise an edge (e.g., a cutting edge) of the implement 120 from a ground surface (e.g., by generating a control signal to cause actuation of the pitch actuator 220). For example, the adjustment to the pitch may be increasing a back pitch of the implement 120 (e.g., to move a top edge of the implement 120 in a direction toward the rear portion 104 of the machine 100). Raising the edge of the implement 120 from the ground surface disengages the implement 120 from the ground surface to pause additional grading.

The controller 202 may identify an end of the windrow being formed by the machine 100 in connection with the grading operation. The controller 202 may exit the autonomous windrow-ending mode based on identifying the end of the windrow. To identify the end of the windrow, the controller 202 may receive an additional input indicating that the windrow has been ended. The controller 202 may receive the additional input via the console 130, via the one or more operator controls 132, via another input device of the operator cab 128, and/or via a remote control device for the machine 100. For example, an operator of the machine 100 may press a button to conclude the end-of-windrow sequence for the machine 100 (e.g., the same button used to initiate the end-of-windrow sequence). Alternatively, the controller 202 may identify the end of the windrow based on data collected by one or more sensors 140 (e.g., using a machine learning model), in a similar manner as described above.

The controller 202 may cause, based on identifying the end of the windrow, raising of the implement 120 from a ground surface (e.g., by generating a control signal to cause actuation of the lift actuators 222, 224). In a similar manner as described above, raising the implement 120 from the ground surface disengages the implement 120 from the ground surface to pause additional grading. For example, adjusting the pitch of the implement 120, as described above, may quickly disengage the implement 120 from the ground surface but only by a small amount, and raising the implement 120 from the ground surface may ensure that there is sufficient clearance between the bottom edge of the implement 120 and the ground surface. In some implementations, after raising the implement 120 from the ground surface, if the pitch was also adjusted, the controller 202 may cause the pitch of the implement 120 to be reset to a position used prior to the adjustment of the pitch.

As indicated above, FIG. 3 is provided as an example. Other examples may differ from what is described with regard to FIG. 3.

Figure 4:
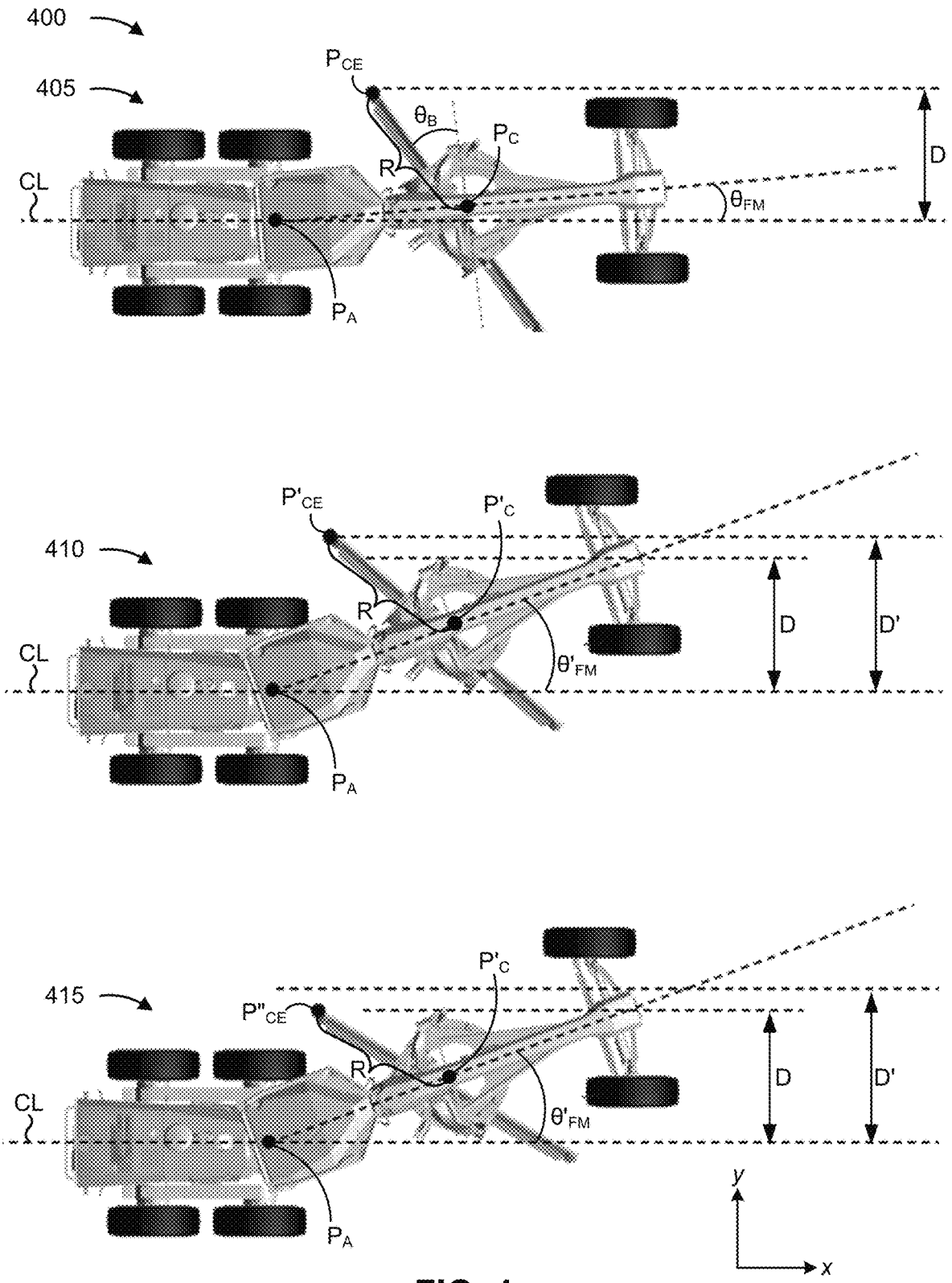
FIG. 4 is a diagram of an example associated with control of a machine to end a windrow.

FIG. 4 is a diagram of an example 400 associated with control of a machine to end a windrow.

Example 400 indicates a technique used by the controller 202 to determine an amount of rotation of the circle 118 (Y degrees, described above) for a given amount of articulation of the front portion 102 relative to the rear portion 104 (X degrees, described above) to increase the angle of the implement 120 in connection with the end-of-windrow sequence, as described above. The top diagram in FIG. 4 shows an example operating condition 405 of the machine 100 at a time when an end-of-windrow sequence is initiated. The middle diagram in FIG. 4 shows an example operating condition 410 of the machine 100 in connection with articulation of the front portion 102 relative to the rear portion 104. The bottom diagram of FIG. 4 shows an example operating condition 415 of the machine 100 in connection with rotation of the circle 118.

In example 400, $P_A$ represents a location of a pin of the articulated joint 106. $P_{CE}$ represents an initial location of a cutting edge (e.g., a trailing edge) of the implement 120, $P'_{CE}$ represents a location of the cutting edge after articulation of the machine 100, and P"CE represents a location of the cutting edge after rotation of the circle 118 (wherein, in the equations below, an "x" appended to one of the aforementioned variables indicates an x-coordinate of a location and a "y" appended to one of the aforementioned variables indicates a y-coordinate of a location). $P_C$ represents an initial center of rotation (COR) of the circle 118 and P'c represents a COR of the circle 118 after articulation of the machine 100 (wherein an "x" appended to one of the aforementioned variables indicates an x-coordinate of a COR and a "y" appended to one of the aforementioned variables indicates a y-coordinate of a COR). $\theta_{FM}$ represents an initial articulation angle of the machine 100 and $\theta'_{FM}$ represents an articulation angle of the machine 100 after articulation of the machine 100. $\theta_B$ represents an initial angle of the implement 120. R represents a distance from the COR of the circle 118 to the cutting edge of the implement 120. D represents an initial distance from the cutting edge of the implement 120 to a center line (CL) of the machine 100, and D' represents a distance from the cutting edge of the implement 120 to the CL of the machine 100 after articulation of the machine 100.

The controller 202 may determine a location (e.g., x, y coordinates) to be used for the cutting edge of the implement 120 for a given articulation angle using Equation 1 and Equation 2:

$$P''_{CEy} = P_{CEy} \quad \text{Equation 1}$$

$$P''_{CEx} = P'_{Cx} \pm \sqrt{R^2 - \left(P''_{CEy} - P'_{Cy}\right)^2} \quad \text{Equation 2}$$

The controller 202 may determine an angle between $P'_{CE}$ and $P''_{CE}$ using Equation 3:

$$\Delta\theta_B = \cos^{-1}\frac{\left((P''_{CEx} - P'_{Cx})(P'_{CEx} - P'_{Cx}) + \left(P''_{CEy} - P'_{Cy}\right)\left(P'_{CEy} - P'_{Cy}\right)\right)}{\sqrt{(P''_{CEx} - P'_{Cx})^2 + \left(P''_{CEy} - P'_{Cy}\right)^2}\sqrt{(P'_{CEx} - P'_{Cx})^2 + \left(P'_{CEy} - P'_{Cy}\right)^2}} = \cos^{-1}\frac{(P''_{CEx} - P'_{Cx})(P'_{CEx} - P'_{Cx}) + \left(P''_{CEy} - P'_{Cy}\right)\left(P'_{CEy} - P'_{Cy}\right)}{R^2} \quad \text{Equation 3}$$

The controller 202 may cause rotation of the circle 118 by an angle $\Delta\theta_B$ such that the cutting edge position $P''_{CEy}$ is equal to $P_{CEy}$ and equal to D. In other words, to compensate for an increase of an articulation of the front portion 102 relative to the rear portion 104 by an angle $\Delta\{\theta_{FM}, \theta'_{FM}\}$ (e.g., by 15 degrees), the controller 202 may cause rotation of the circle 118 so that a distance between the cutting edge of the implement 120 and the center line of the machine 100 is the same as an initial distance between the cutting edge of the implement 120 and the center line without the increase of the articulation. In this way, the articulation of the front portion 102 relative to the rear portion 104 and the rotation of the circle 118, in combination, increases the angle of the implement 120 by pivoting the implement 120 about the cutting edge of the implement 120 (e.g., the cutting edge of the implement 120 translates along a straight line to maintain a windrow in a straight line).

As indicated above, FIG. 4 is provided as an example. Other examples may differ from what is described with regard to FIG. 4.

Figure 5:
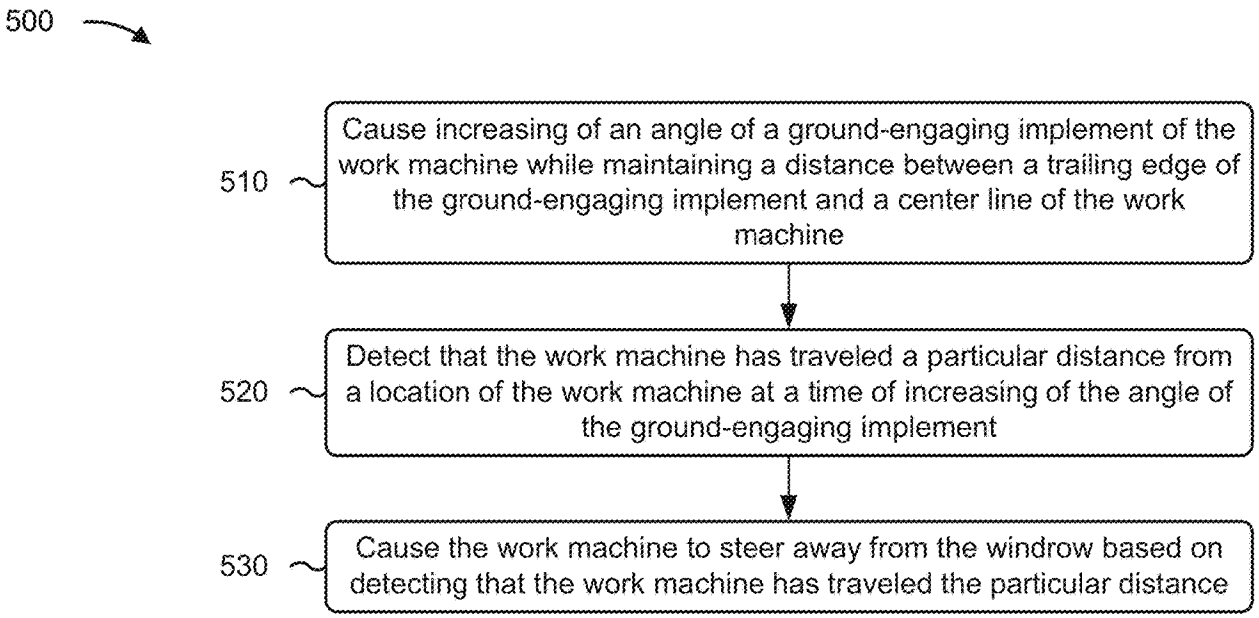
FIG. 5 is a flowchart of an example process associated with control of a machine to end a windrow.

FIG. 5 is a flowchart of an example process 500 associated with control of a machine to end a windrow. One or more process blocks of FIG. 5 may be performed by a controller (e.g., controller 202). Additionally, or alternatively, one or more process blocks of FIG. 5 may be performed by another device or a group of devices separate from or including the controller, such as another device or component that is internal or external to the machine 100. Process 500 may relate to ending a windrow being formed by a work machine during a grading operation.

Process 500 may include receiving an input indicating that a windrow, being formed in connection with a grading operation, is to be ended. Alternatively, process 500 may include obtaining data collected by one or more optical sensors or sonic sensors of the work machine, where the data indicates an arrangement of one or more windrows, and determining, based on the data, that the work machine is to perform the operation to end the windrow.

As shown in FIG. 5, process 500 may include causing increasing of an angle of a ground-engaging implement of the work machine while maintaining a distance between a trailing edge of the ground-engaging implement and a center line of the work machine (block 510). For example, the controller may cause increasing of an angle of a ground-engaging implement of the work machine, as described above. Causing increasing of the angle of the ground-engaging implement of the work machine may include causing articulation of a front portion of the work machine relative to a rear portion of the work machine and rotation of a circle of a linkage assembly of the front portion.

Process 500 may include determining whether at least one of the articulation of the front portion relative to the rear portion or the rotation of the circle is to result in a collision of the ground-engaging implement with the work machine, and causing increasing of the angle of the ground-engaging implement may be based on a determination that the articulation of the front portion relative to the rear portion and the rotation of the circle is not to result in the collision of the ground-engaging implement with the work machine. Process 500 may include monitoring a position of the ground-engaging implement during the grading operation to identify the leading edge and the trailing edge of the ground-engaging implement.

As further shown in FIG. 5, process 500 may include detecting that the work machine has traveled a particular distance from a location of the work machine at a time of increasing of the angle of the ground-engaging implement (block 520). For example, the controller may detect that the work machine has traveled a particular distance, as described above. The particular distance may be at least half a length of the work machine.

As further shown in FIG. 5, process 500 may include causing the work machine to steer away from the windrow based on detecting that the work machine has traveled the particular distance (block 530). For example, the controller may cause the work machine to steer away from the windrow, as described above. Alternatively, in some examples, process 500 may include causing an alert to be provided indicating that the work machine is to be steered away from the windrow.

Process 500 may include causing, based on causing steering away from the windrow, an adjustment to a pitch of the ground-engaging implement to raise an edge of the ground-engaging implement from a ground surface. Process 500 may include receiving an additional input indicating that the windrow has been ended, and causing raising of the ground-engaging implement from a ground surface. Process 500 may include causing a pitch of the ground-engaging implement to be reset to a position used prior to an adjustment of the pitch.

Although FIG. 5 shows example blocks of process 500, in some implementations, process 500 may include additional blocks, fewer blocks, different blocks, or differently arranged blocks than those depicted in FIG. 5. Additionally, or alternatively, two or more of the blocks of process 500 may be performed in parallel.

INDUSTRIAL APPLICABILITY

The control system described herein may be used with any machine having a ground-engaging implement suitable for performing grading of a surface. For example, the control system may be used with a motor grader that has a ground-engaging implement, such as a blade or a moldboard. Due to the many degrees of freedom of the implement, an operator of the motor grader may have difficulty controlling the position of the implement. Accordingly, a windrow formed by the motor grader may be ended (e.g., at an end of a pass) with a lack of precision, where an end of the windrow is characterized by material spread out over a large area rather than a tight taper. As a result, the windrow may not be fully cleared on a return pass, thereby leaving excess material behind. The excess material may result in an uneven surface, may prevent adequate mixing of material, and/or may eventually lead to more frequent road maintenance. Moreover, the excess material may wear or damage the tires of the motor grader or of other machines traversing the area. Furthermore, the excess material can become compacted, making removal and repair of the excess material time consuming, which may use excessive machine hours, increase machine wear, and/or increase fuel usage.

The control system described herein is useful for ending a windrow in a straight, tight taper. In particular, based on identifying that a windrow is to be ended, the control system may cause increasing of an angle of the implement while maintaining a distance between a trailing edge of the implement and a center line of the machine. This allows faster discharge of material from the implement while maintaining a linearity of the windrow. In this way, the control system enables ending of a windrow without leaving excess material spread over a large area. Accordingly, the control system provides an improved quality road surface, reduces wear or damage to the machine, or other machines, that can be caused by traversing over areas with excess material, and reduces the need to remove or repair excess material buildup, thereby conserving machine hours, reducing machine wear, and conserving fuel.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A motor grader, comprising:

a front portion;

a rear portion;

an articulated joint between the front portion and the rear portion;

a linkage assembly of the front portion, the linkage assembly comprising a drawbar, a circle connected to the drawbar, and a ground-engaging implement, connected to the circle, positionable at an angle that defines a leading edge and a trailing edge of the ground-engaging implement; and a controller configured to:

receive an input indicating that a windrow, being formed by the motor grader in connection with a grading operation, is to be ended;

cause, based on the input, increasing of the angle of the ground-engaging implement by articulation of the front portion relative to the rear portion and rotation of the circle;

detect that the motor grader has traveled a particular distance from a location of the motor grader at a time of increasing of the angle of the ground-engaging implement; and perform a windrow-ending action based on detecting that the motor grader has traveled the particular distance.

2. The motor grader of claim 1, wherein the controller, to perform the windrow-ending action, is configured to:

cause an alert to be provided indicating that the motor grader is to be steered away from the windrow.

3. The motor grader of claim 1, wherein the controller, to perform the windrow-ending action, is configured to:

cause the motor grader to steer away from the windrow.

4. The motor grader of claim 1, wherein the controller is further configured to:

monitor a position of the ground-engaging implement during the grading operation to identify the leading edge and the trailing edge of the ground-engaging implement.

5. The motor grader of claim 1, wherein the controller is further configured to:

cause, based on performing the windrow-ending action, an adjustment to a pitch of the ground-engaging implement to raise an edge of the ground-engaging implement from a ground surface.

6. The motor grader of claim 1, wherein the controller is further configured to:

receive an additional input indicating that the windrow has been ended; and cause raising of the ground-engaging implement from a ground surface.

7. The motor grader of claim 6, wherein the controller is further configured to:

cause a pitch of the ground-engaging implement to be reset to a position used prior to an adjustment of the pitch.

8. The motor grader of claim 1, wherein the ground-engaging implement is a moldboard.

9. A control system for a work machine having a linkage assembly including a drawbar, a circle connected to the drawbar, and a ground-engaging implement, connected to the circle, positionable at an angle that defines a leading edge and a trailing edge of the ground-engaging implement, the control system comprising:

one or more sensors configured to detect a position of the ground-engaging implement;

a circle rotation actuator configured to rotate the circle;

an articulation actuator configured to articulate a front portion of the work machine relative to a rear portion of the work machine; and a controller configured to:

identify that the work machine is to perform an operation to end a windrow being formed by the work machine in connection with a grading operation;

cause, based on identifying that the work machine is to perform the operation, increasing of the angle of the ground-engaging implement by articulation of the front portion relative to the rear portion and rotation of the circle;

detect that the work machine has traveled a particular distance from a location of the work machine at a time of increasing of the angle of the ground-engaging implement; and perform a windrow-ending action based on detecting that the work machine has traveled the particular distance.

10. The control system of claim 9, wherein the controller, to identify that the work machine is to perform the operation to end the windrow, is configured to:

receive an input indicating that the work machine is to perform the operation to end the windrow.

11. The control system of claim 9, wherein the controller, to identify that the work machine is to perform the operation to end the windrow, is configured to:

obtain data collected by one or more optical sensors or sonic sensors of the work machine, wherein the data indicates an arrangement of one or more windrows; and determine, based on the data, that the work machine is to perform the operation to end the windrow.

12. The control system of claim 9, wherein the articulation of the front portion relative to the rear portion is concurrent with the rotation of the circle.

13. The control system of claim 9, wherein the articulation of the front portion relative to the rear portion is to bring the front portion nearer to the windrow.

14. The control system of claim 9, wherein the rotation of the circle is to bring the leading edge of the ground-engaging implement nearer to the windrow.

15. The control system of claim 9, wherein the controller, to perform the windrow-ending action, is configured to:

cause an alert to be provided indicating that the work machine is to be steered away from the windrow.

16. The control system of claim 9, wherein the controller, to perform the windrow-ending action, is configured to:

cause the work machine to steer away from the windrow.

17. A method to end a windrow being formed by a work machine, comprising:

causing, by a controller for the work machine, increasing of an angle of a ground-engaging implement of the work machine while maintaining a distance between a trailing edge of the ground-engaging implement and a center line of the work machine;

detecting that the work machine has traveled a particular distance from a location of the work machine at a time of increasing of the angle of the ground-engaging implement; and causing the work machine to steer away from the windrow based on detecting that the work machine has traveled the particular distance.

18. The method of claim 17, wherein causing increasing of the angle of the ground-engaging implement of the work machine comprises:

causing articulation of a front portion of the work machine relative to a rear portion of the work machine and rotation of a circle of a linkage assembly of the front portion.

19. The method of claim 18, further comprising:

determining whether at least one of the articulation of the front portion relative to the rear portion or the rotation of the circle is to result in a collision of the ground-engaging implement with the work machine, wherein causing increasing of the angle of the ground-engaging implement is based on a determination that the articulation of the front portion relative to the rear portion and the rotation of the circle is not to result in the collision of the ground-engaging implement with the work machine.

20. The method of claim 17, wherein the particular distance is at least half a length of the work machine.

* * * * *